US007179117B2

(12) United States Patent
Wu

(10) Patent No.: US 7,179,117 B2
(45) Date of Patent: Feb. 20, 2007

(54) CABLE ASSEMBLY WITH UNIQUE STRAIN RELIEF MEANS

(75) Inventor: Jerry Wu, Irvine, CA (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 5 days.

(21) Appl. No.: 11/119,300

(22) Filed: Apr. 28, 2005

(65) Prior Publication Data

US 2006/0246770 A1 Nov. 2, 2006

(51) Int. Cl.
*H01R 13/58* (2006.01)

(52) U.S. Cl. ..... 439/460

(58) Field of Classification Search ..... 439/460, 439/63, 456–458, 701, 461, 459, 146–147, 439/465, 76.1, 607–610
See application file for complete search history.

(56) References Cited

U.S. PATENT DOCUMENTS 5,383,796 A 1/1995 Bowen et al.
6,293,829 B1 * 9/2001 Qiao et al. ..... 439/719
6,302,724 B1 * 10/2001 Meller ..... 439/457
6,315,600 B1 * 11/2001 Droesbeke ..... 439/460
6,530,789 B2 3/2003 Konda
6,585,528 B1 * 7/2003 Lin et al. ..... 439/76.1
6,663,415 B1 12/2003 Wu
6,811,441 B2 11/2004 Simpson
6,875,046 B2 * 4/2005 Chiu et al. ..... 439/460
7,018,241 B2 * 3/2006 Caveney et al. ..... 439/676
7,059,891 B2 * 6/2006 Bury ..... 439/461

* cited by examiner

*Primary Examiner*—J. F. Duverne
(74) *Attorney, Agent, or Firm*—Wei Te Chung

(57) ABSTRACT

A cable assembly (1) includes a connector module (3), a first cover-half (41) and a second cover-half (42) assembled to the first cover-half to enclose the connector module therebetween. The connector module includes an insulative housing (33), a number of contacts (35) retained in the insulative housing, a printed circuit board (34) assembled to the insulative housing and electrically connecting with the contacts, a number of cables (32) electrically connecting with the printed circuit board to form a number of junctions, and strain relief means (31). The strain relief means includes a main portion (310) molded with the junctions, a strain relief section (312) molded with the cables and interferentially received in a receiving hole (13) formed between the first and second cover-halves.

22 Claims, 10 Drawing Sheets

CABLE ASSEMBLY WITH UNIQUE STRAIN RELIEF MEANS

BACKGROUND OF THE INVENTION

1. Field of the Invention

The present invention generally relates to a cable assembly, and more particularly to a high speed cable assembly.

2. Description of Related Art

When a cable or the like is terminated by an electrical connector to form a cable assembly, strain relief means is provided to minimize forces exerted on the junctions between conductors of the cable and contacts of the electrical connector. Strain relief means assembled to the cable and the electrical connector requires proper compression of the cable and holds the cable firmly.

U.S. Pat. No. 5,383,796 issued to Molex on Jan. 24, 1995 discloses a traditional metal strain relief structure 56 crimped to a cable manually. The strain relief 56 includes a center section 6 adapted to embrace one side of the cable, a pair of wing sections 62 extending from the center section 60 and having screw-receiving holes 58 in alignment with screw posts 38 defined on a connector housing 18. A pair of screws 50 are respectively assembled to the screw posts 38 and the screw-receiving holes 58 to secure the strain relief 56 and the cable. However, when the strain relief 56 is secured to shell means 18 enclosing the connector housing 18, the cable may suffer too great external force that could damage the cable and render degradation in electrical performance. Moreover, such design is unfavorable for high speed application because it ignores Electro Magnetic Interference (EMI) leakage between the strain relief 56 and the shell means 18. In addition, the process of crimping the strain relief 56 to the cable is completed manually, and therefore is imprecise and time consuming.

Summarily, an improved strain relief is highly needed to solve above-mentioned problems.

BRIEF SUMMARY OF THE INVENTION

Accordingly, an object of the present invention is to provide a cable assembly with improved strain relief means with aid of time spare and low cost.

In order to achieve the above-mentioned object, a cable assembly in accordance with the present invention comprises a connector module, a first cover-half and a second cover-half assembled to the first cover-half to enclose the connector module therebetween. The connector module comprises an insulative housing, a plurality of contacts retained in the insulative housing, a printed circuit board assembled to the insulative housing and electrically connecting with the contacts, a plurality of cables electrically connecting with the printed circuit board to form a plurality of junctions, and strain relief means. The strain relief means comprises a main portion molded with the junctions, a strain relief section molded with the cables and interferentially received in a receiving hole formed between the first and second cover-halves.

Other objects, advantages and novel features of the invention will become more apparent from the following detailed description of the present embodiment when taken in conjunction with the accompanying drawings.

DETAILED DESCRIPTION OF THE INVENTION

Figure 1:
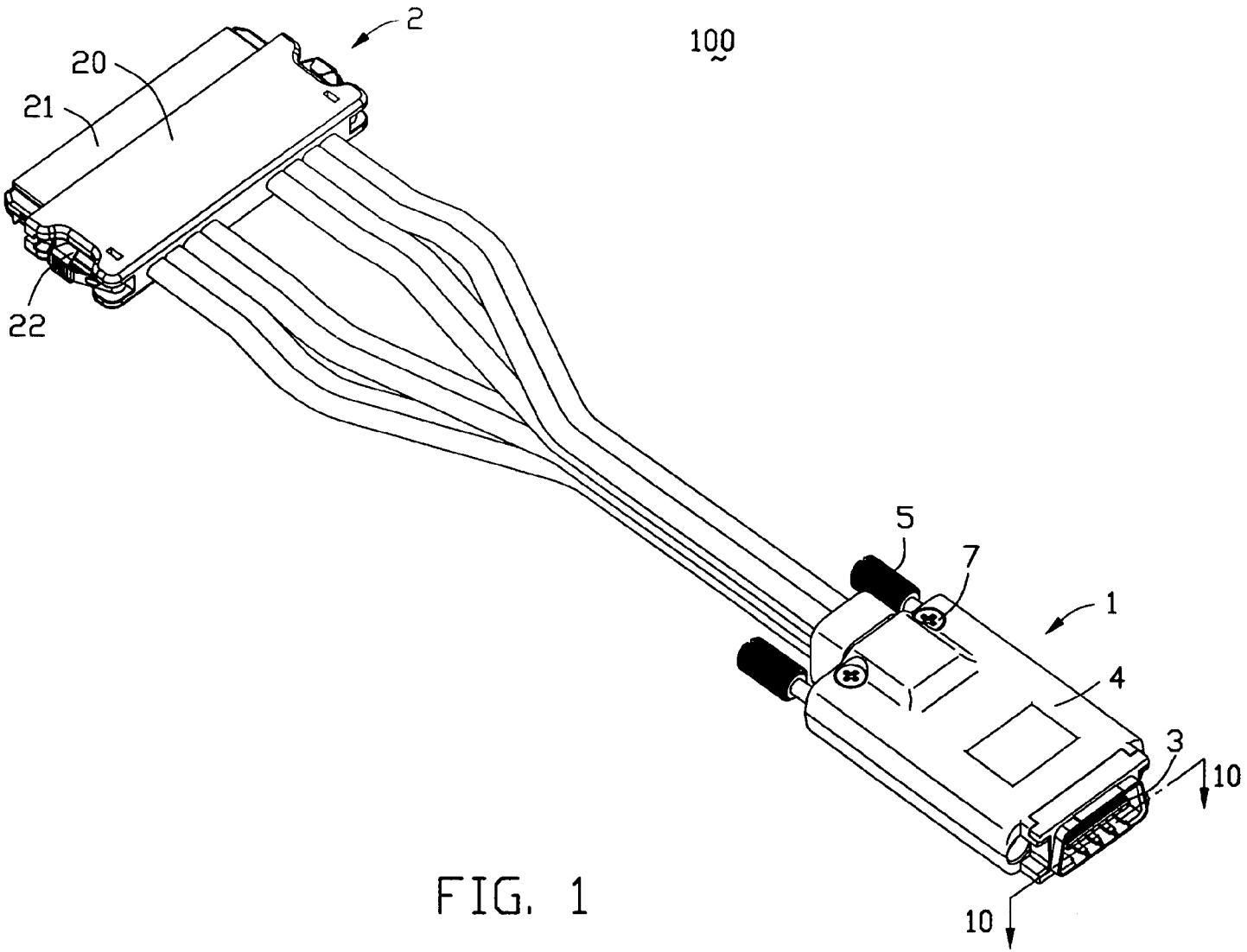
FIG. 1 is an assembled, perspective view of a cable assembly in accordance with the present invention and a complementary Serial ATA cable end connector.
Figure 2:
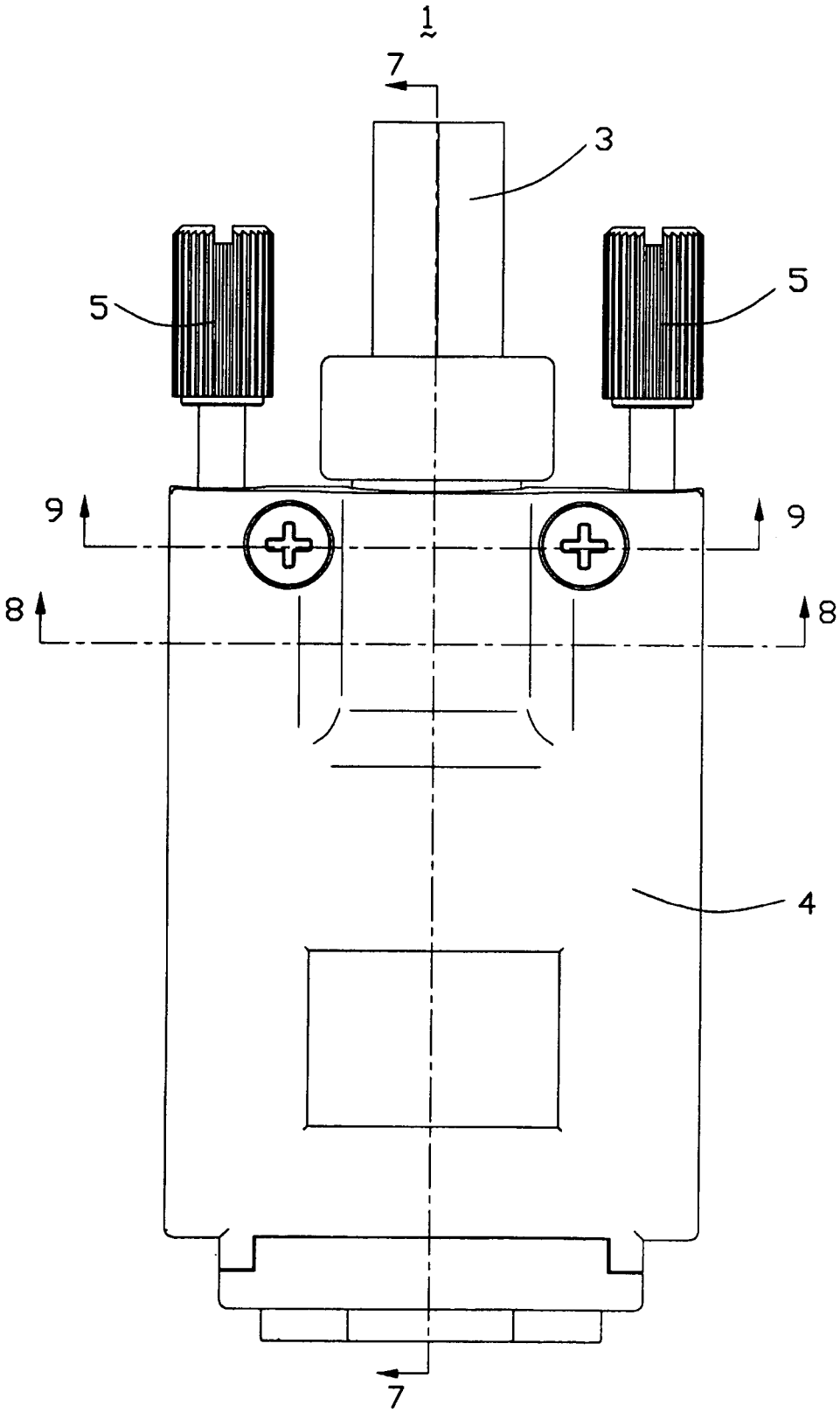
FIG. 2 is top plan view of the cable assembly of the present invention.

Reference will now be made to the drawing figures to describe the present invention in detail.

Referring to FIGS. 1–4, a cable assembly 1 in accordance with the present invention is electrically connected with a complementary connector 2 to form an electrical assembly 100. In the preferred embodiment, the complementary connector 2 is a Serial Advanced Technology Attachment (ATA) II cable end connector. The complementary connector 2 comprises a mating portion 21, a plurality of terminals received in the mating portion 21, a plurality of cables 32 electrically connecting with the mating portion 21, and a molded cover 20 molded with the junctions between the cables 32 and the terminals. A pair of latches are pivotally assembled to the molded cover 20 for latching with an outer device.

The cable assembly 1 comprises a connector module 3, a die-cast cover 4 enclosing the connector module 3, a pair of fastening members 5 assembled to the die-cast cover 4 for disengaging the cable assembly 1 from a complementary device, and a pair of screws 7.

Figure 3:
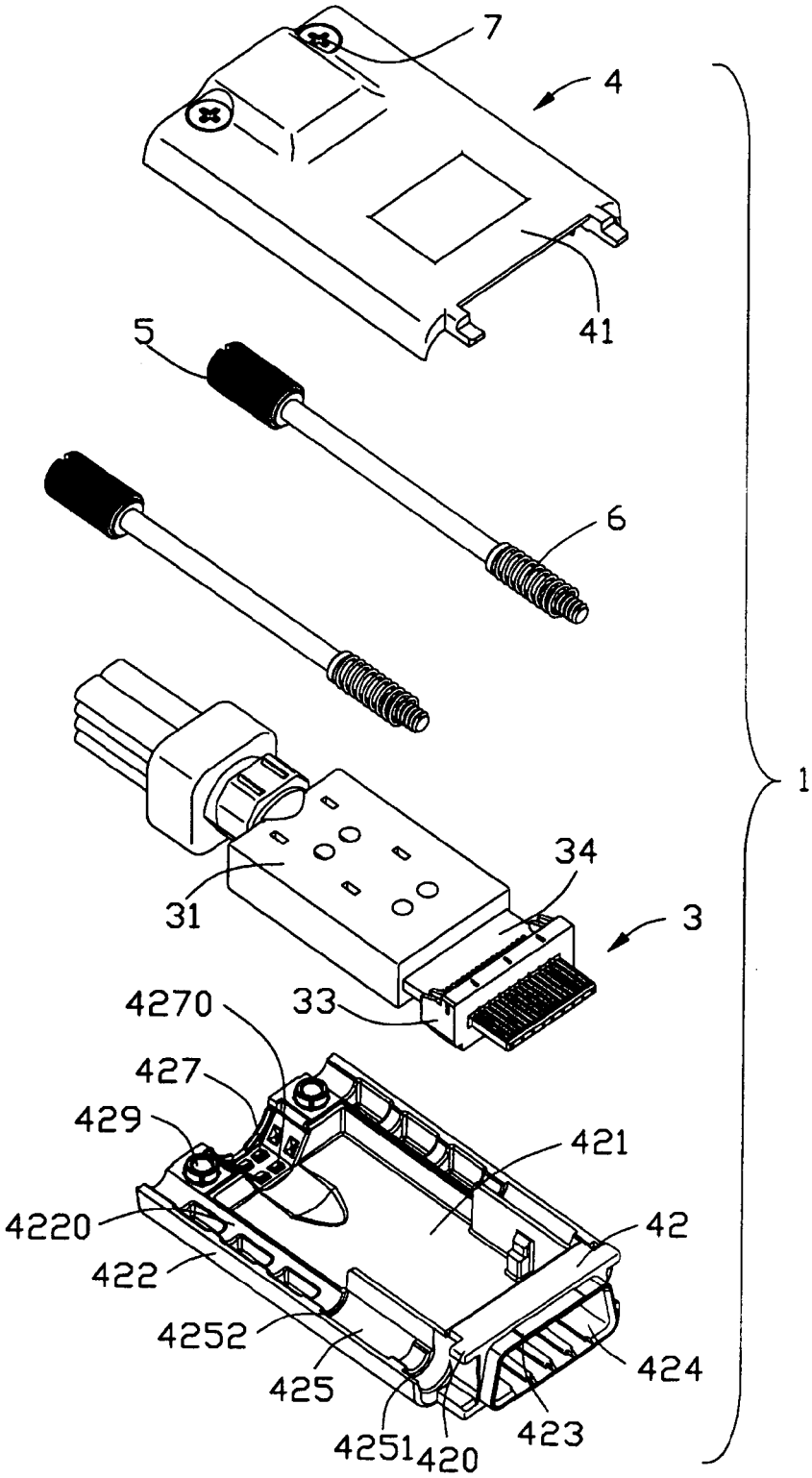
FIG. 3 is an exploded, perspective view of the cable assembly of the present invention.
Figure 4:
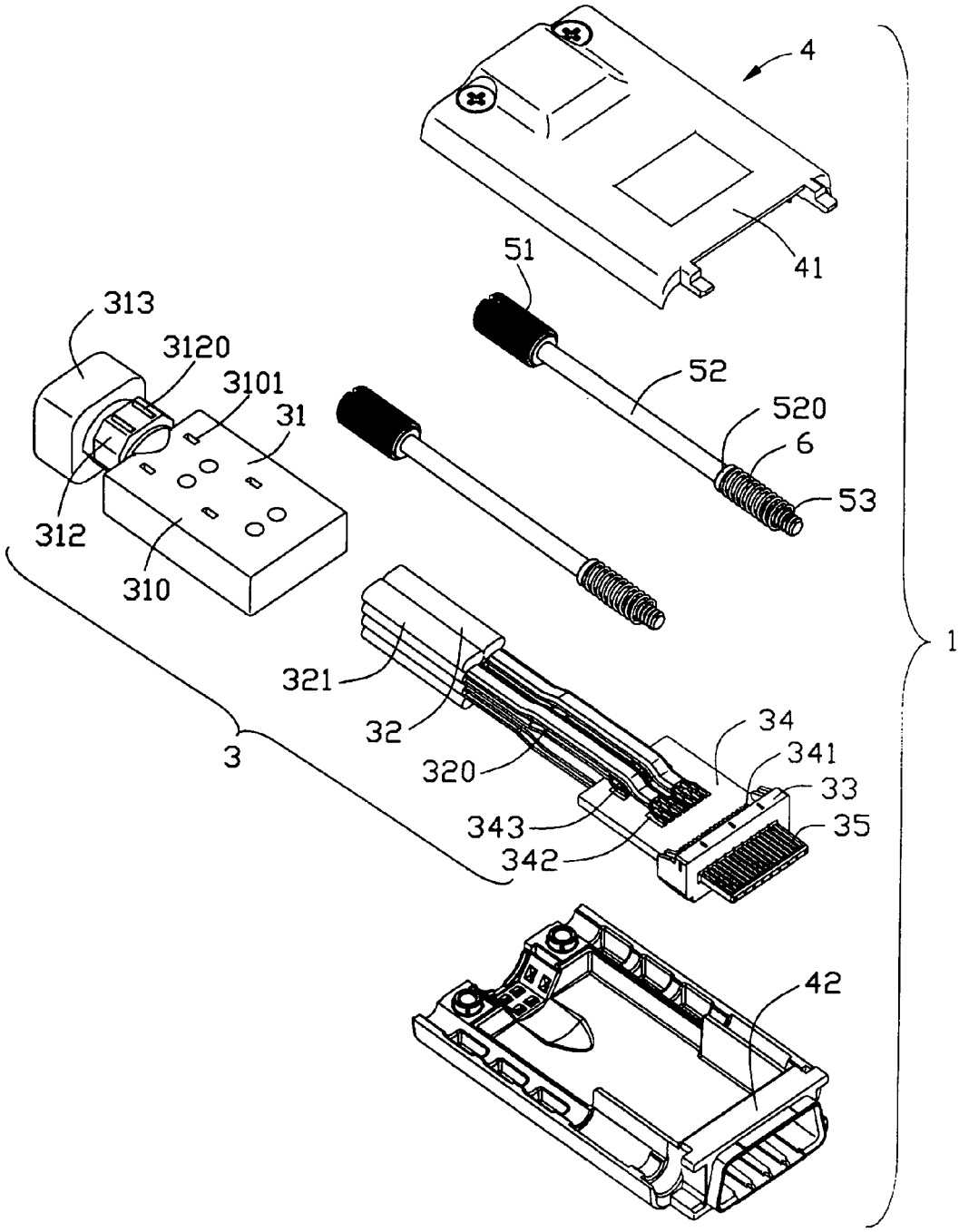
FIG. 4 is a view similar to FIG. 3, but taken from a different aspect.
Figure 5:
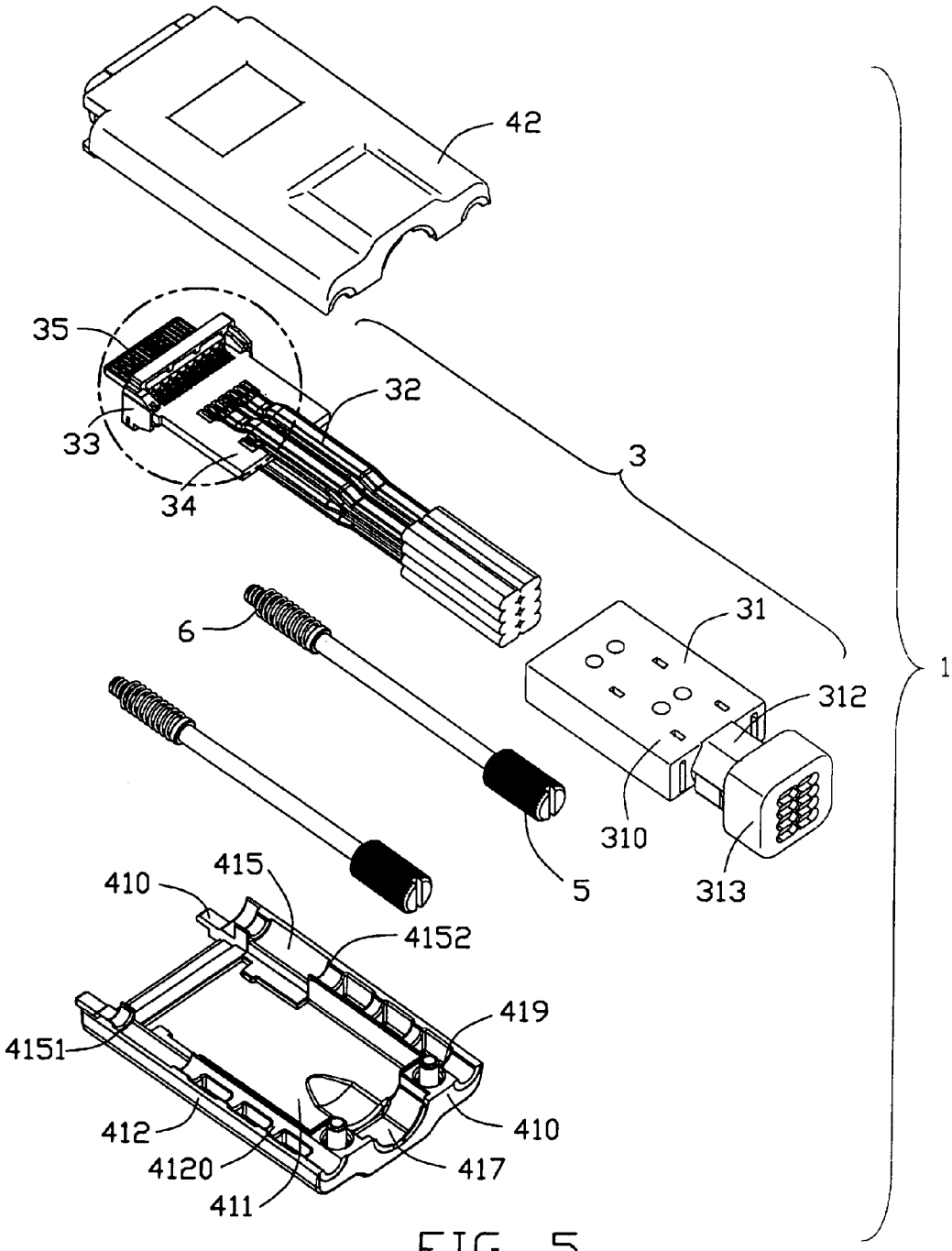
FIG. 5 is also a view similar to FIG. 3, but taken from another aspect.

Referring to FIGS. 3–5, the die-cast cover 4 comprises a first cover-half 41 and a second cover-half 42 assembled with the first cover-half 41.

The first cover-half 41 comprises a rectangular first body portion 411, a pair of first flanges 412 extending downwardly from opposite lateral sides of the first body portion 411, and a pair of spaced fingers 410 extending forwardly from a front portion of the first body portion 411. The first body portion 411 defines a first substantially semicircular opening 417 at a rear end thereof. Each first flange 412 defines a first channel 4120 extending through a whole length thereof. A first recessed section 415 is further formed in the first channel 4120. The first recessed section 415 recesses more deeply and widely than other portions of the first channel 412 and forms a front edge 4151 and an opposite rear edge 4152. A pair of first screw holes 419 are defined in the rear end of the first cover-half 41 and spaced by the first semicircular opening 417.

The second cover-half 42 comprises a mating frame 423 defining a cavity 424 therein and a second body portion 421 extending rearward from the mating frame 423. The mating frame 423 has a pair of engaging ears 420 extending laterally and outwardly from a top section thereof. The second body portion 421 comprises a pair of second flanges 422 extending upwardly from opposite lateral sides thereof. Each flange 422 defines a second channel 4220 extending through a whole length thereof. A second recessed section 425 is further defined in the second channel 4220 with a deeper and wider size than that of other portion of the second channel 4220. The second recessed section 425 forms a corresponding front edge 4251 and an opposite rear edge 4252. The second body portion 421 defines a second substantially semicircular opening 427 at a rear end thereof. A pair of second screw holes 429 are formed at the rear end of the second body portion 421 and spaced by the second semicircular opening 427. A plurality of extrusions 4270 is formed on periphery of the second semicircular opening 427.

Figure 6:
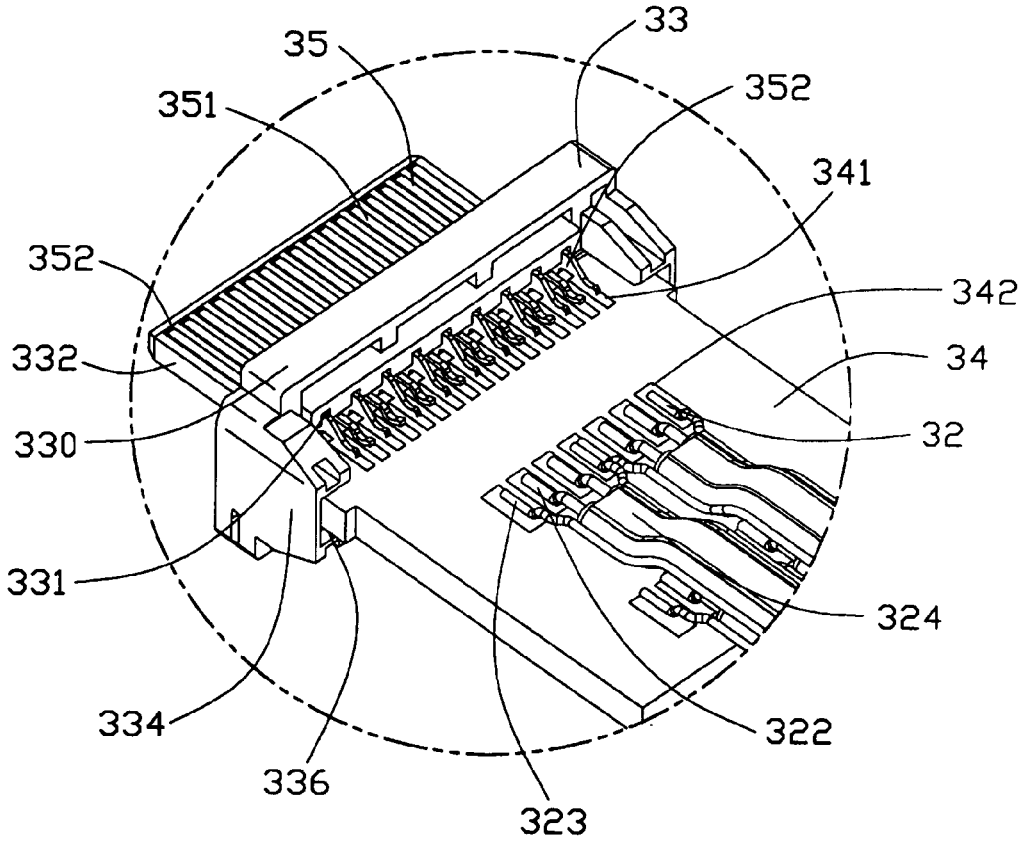
FIG. 6 is an enlarged view of a circled portion of FIG. 5.
Figure 7:
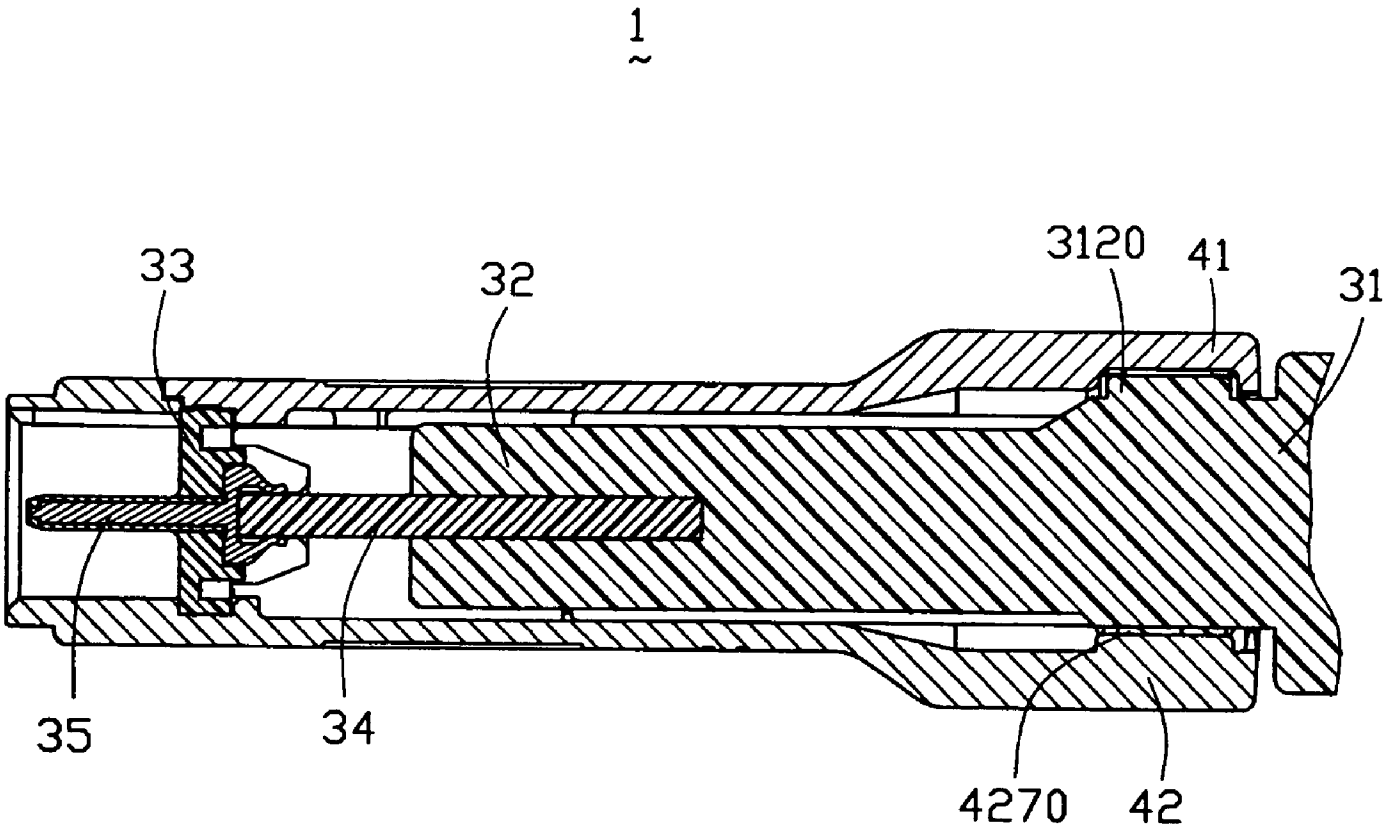
FIG. 7 is a cross-section view of the cable assembly taken along line 7—7 of FIG. 2.
Figure 8:
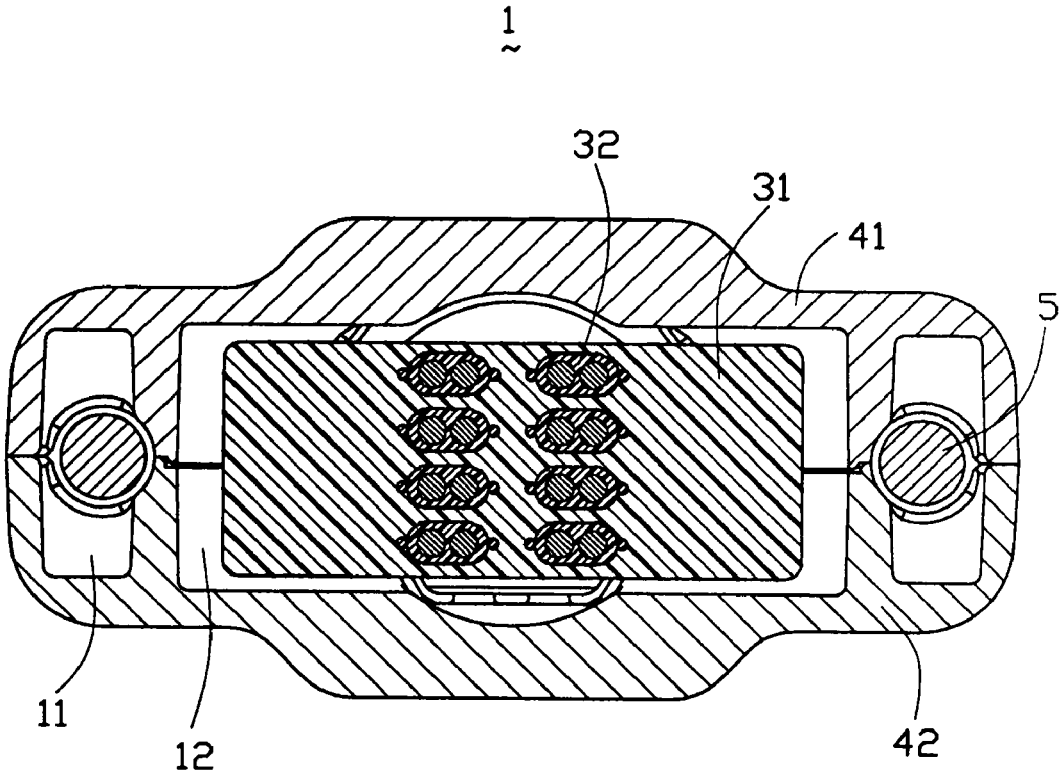
FIG. 8 is a cross-section view of the cable assembly taken along line 8—8 of FIG. 2.
Figure 9:
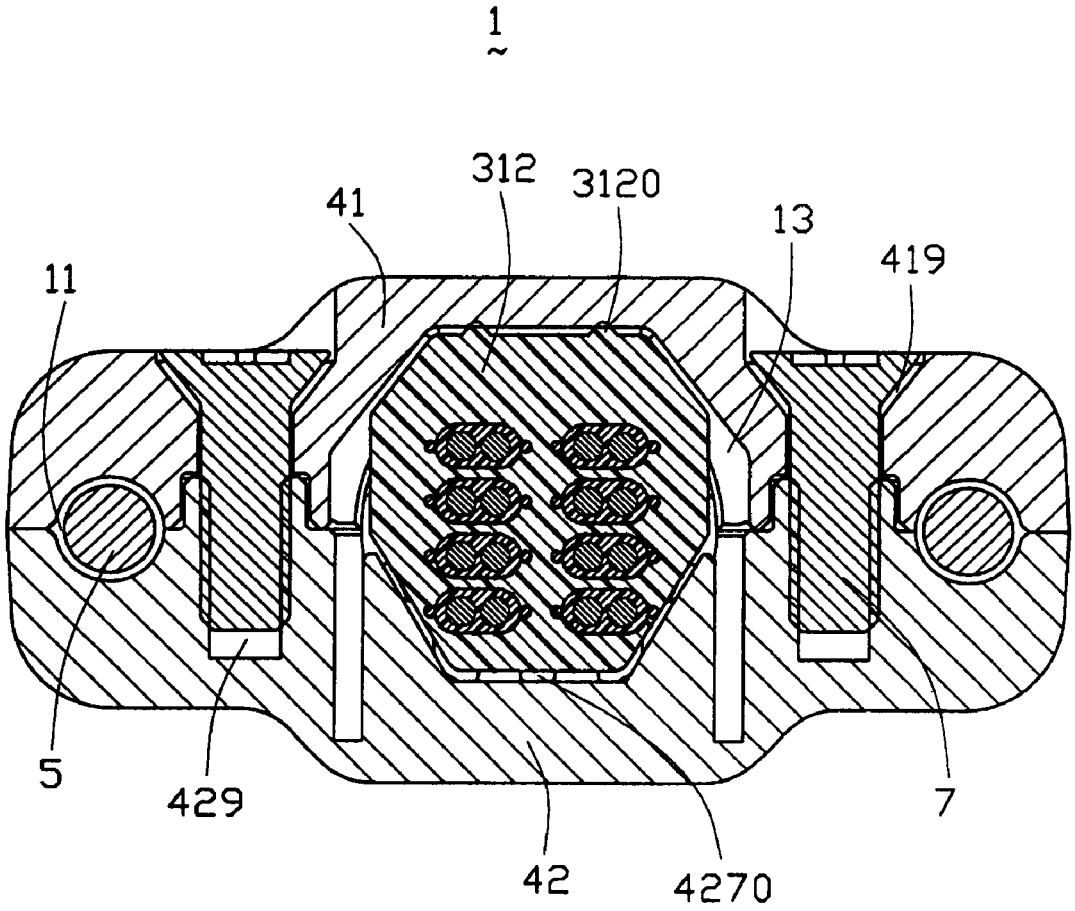
FIG. 9 is a cross-section view of the cable assembly taken along line 9—9 of FIG. 1.
Figure 10:
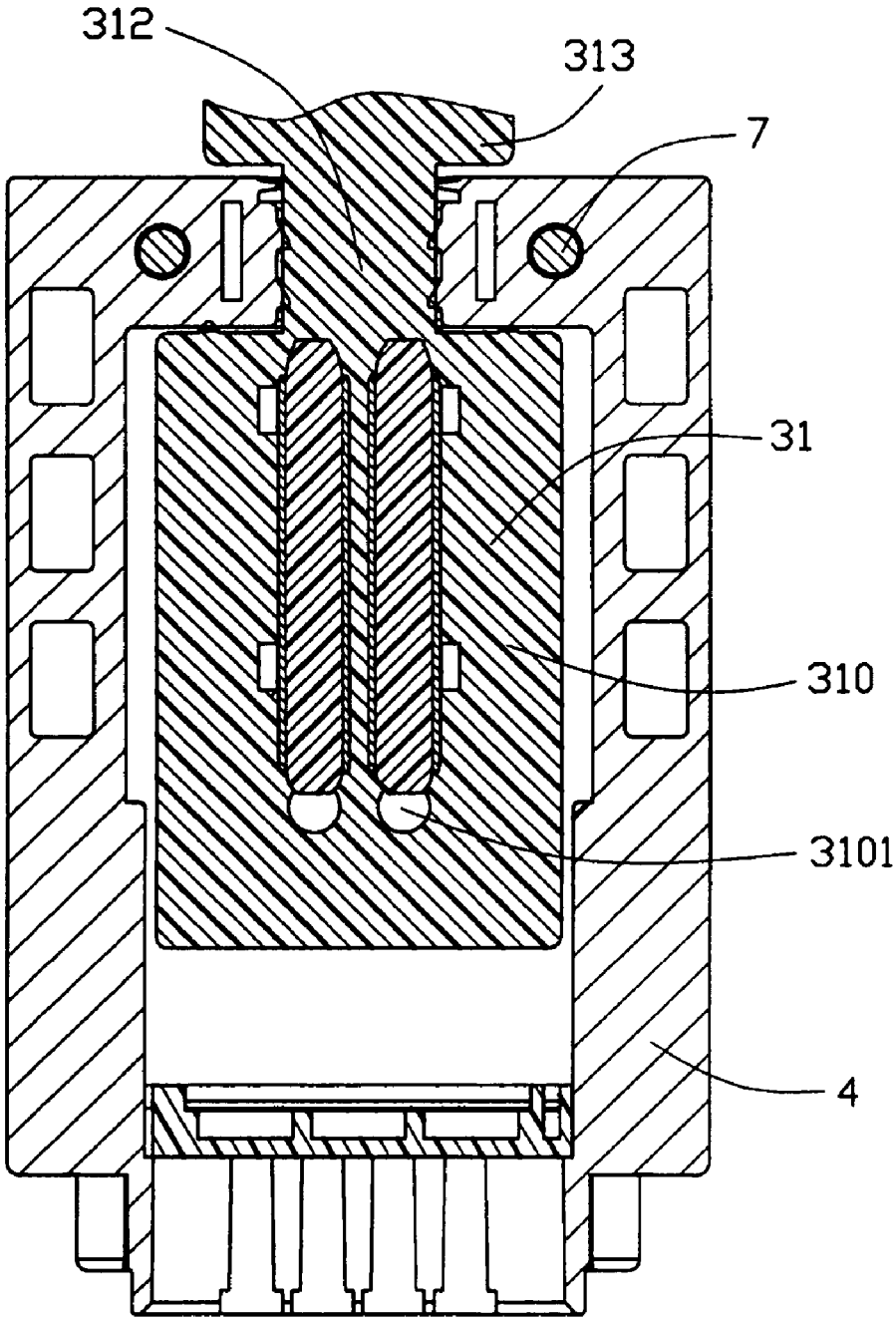
FIG. 10 a cross-section view of the cable assembly taken along line 10—10 of FIG. 1.

Referring to FIGS. 4–6, the connector module 3 of the cable assembly 1 comprises an insulative housing 33, a plurality of contacts 35 retained in the insulative housing 33, a printed circuit board (PCB) 34 assembled to the insulative housing 33 to electrically connect with the contacts 35, a plurality of cables 32 electrically connecting with the PCB 34, and strain relief means 31 molded with the cables 32 and the PCB 34. The insulative housing 33 comprises a base portion 330, a tongue portion 332 extending forwardly form the base portion 330, and a pair of supporting portions 334 extending rearward from opposite lateral ends of the base portion 330. The base portion 330 is defined with a plurality of passageways 301 and the tongue portion 332 is defined with a plurality of passages 332 at opposite surfaces thereof. The passages 332 respectively communicate with corresponding passageways 301. Each supporting portion 334 defines an inner-opened slot 336.

The contact 35 assembled to the insulative housing 33 comprises a contacting portion 351 received in the passage 332, a retention portion (not shown) engaging with the passageway 301 for retaining the contact 35 in the housing 33, and a tail portion 352 extending rearward from the retention portion and located between the pair of supporting portions 334.

The printed circuit board 34 slides along the slots 336 of the supporting portions 334 of the insulative housing 33, thus, retained by the pair of supporting portions 334. The PCB 34 forms a plurality of first, second and third conductive traces 341, 342, 343 at opposite surfaces of a front portion, middle and a rear portion thereof. The second and third conductive traces 342, 343 are arranged with equal trace number and interval. The tail portions 352 of the contacts are respectively soldered with the first conductive traces 341.

The cables 32 comprise four Serial ATA standard cables. Each cable 32 comprises a pair of subassemblies 320 enclosed by an outer jacket 321. Each subassembly 320 comprises a pair of signal conductors 322 and a pair of grounding conductors 323 located at opposite sides of the signal conductors 322. The pair of signal conductors 322 respectively transmit positive and negative signals and are enclosed by an insulative layer 324. The outer jacket 321 of each cable 32 is stripped to expose the inner subassemblies 320. The insulative layer 324 is also stripped to expose inner signal conductors 322 and grounding conductors 323. The exposed conductors 322, 323 are respectively soldered to the second and third conductive traces 342, 343 to form a plurality of junctions and an electrical connection with the contacts 35.

The strain relief means 31 is made of insulative material and over molded with the junctions between the cables 32 and the PCB 34 and the subassemblies 320 exposed outside the outer jacket 321. The strain relief means 31 comprises a flat main portion 310, a strain relief section 312 extending rearward from the main portion 310 and a cable-tie section 313. The main portion 310 is molded with the junctions between the cables 32 and the PCB 34 and forms a plurality of slots for holding the cables 32 when molding. The strain relief section 312 forms a pair of ribs 3120 on upper surface thereof and is molded with the subassemblies exposed outside the outer jacket. The cable-tie section 313 is molded with the cables 32 exposed outside.

The connector module 3 is assembled to the second cover-half 42 with the insulative housing 33 with the contacts 35 received in the mating frame 423, and the PCB 341 and the main portion 310 of the strain relief means 31 lying on the second body portion 421. The strain relief section 312 is interferentially received in the second semicircular opening 427 and the cable-tie section 313 is exposed outside the second cover-half 42.

The pair of fastening members 5 with a pair of springs 6 assembled thereon is movably received in the channels 4220 of the second cover-half 42. Each fastening member 5 comprises a cylindrical medial portion 52 received in rear portion of the channel 4220, a threaded portion 53 received in the recessed portion 425 of the channel 4220, and an operating portion 51 exposed beyond a rear face of the second cover-half 42.

The first cover-half 41 is assembled to the second cover-half 42 with the fingers 410 engaging with the engaging ears 420 to secure the engagement between the first and second cover-halves 41, 42. The screws 7 respectively protrude through the first and second screw holes 419, 429 to further fasten the first and second cover-halves 41, 42. The first and second channels 4120, 4220 together define a receiving passage 11 to wholly receive the fastening member 5 therein. A receiving space 12 is formed between the first and second body portion 411, 421 to wholly receive the main portion 310 of the strain relief means 31. The first and second semicircular openings 417, 427 together define a receiving hole 13 to receive the cables 32 and the strain relief section 312 of the strain relief means 31 with the pair of ribs 3120 interferentially engaging with inner surface of the first semicircular opening 417 and the extrusions 4270 of the second semicircular opening 427 engaging with the strain relief section 312.

When a pulling force is exerted on the cables 32 exposed outside, the pulling force is transferred from the cables 32 to the strain relief means 31, then to the cover-halves 41, 42 and is not exerted to the junctions between the cables 32 and the PCB 34. Thus, the electrical connection is assured.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly, comprising:

a connector module comprising:

an insulative housing;

a plurality of contacts assembled to the insulative housing;

a printed circuit board electrically connecting with the contacts;

at least one cable comprising a plurality of conductors electrically connecting with the printed circuit board to form a plurality of junctions therebetween; and strain relief means comprising a main portion molded with said junctions between the at least one cable and the printed circuit board and a strain relief section molded with the said at least one cable; and a cover enclosing the connector module, the cover defining a receiving hole, the strain relief section of said strain relief means and the at least one cable molded therein interferentially received in the receiving hole; and wherein the at least one cable is a standard Serial Advanced Technology Attachment (ATA) cable and comprises a pair of signal conductors and a pair of grounding conductors located at opposite sides of the signal conductors.

2. The cable assembly as claimed in claim 1, wherein the main portion of the stain relief means forms a slot to grasp the at least one cable when molding the strain relief means.

3. The cable assembly as claimed in claim 1, wherein the strain relief section of the strain relief means forms at least one rib on a periphery thereof to engage with the receiving hole of the cover.

4. The cable assembly as claimed in claim 3, wherein the cover comprises a first cover-half and a second cover-half assembled to the first cover-half, and wherein the receiving hole is formed by a first semicircular opening formed in a rear portion of the first cover-half and a second semicircular opening formed in a rear portion of the second cover-half.

5. The cable assembly as claimed in claim 4, wherein the at least one rib of the swain relief section of the strain relief means engages with the first semicircular opening of the first cover.

6. The cable assembly as claimed in claim 3, wherein the second semicircular opening of the second cover-half forms a plurality of extrusions to engage with the strain relief section of the strain relief means.

7. The cable assembly as claimed in claim 1, wherein the strain relief means further forms a cable-tie section to hold the portion of the at least one cable exposed outside, and wherein the strain relief section is formed between the main portion and the cable-tie section.

8. The cable assembly of claim 1, wherein the pair of signal conductors of the at least one cable is wrapped by an insulative layer to isolate from the pair of grounding conductors, and wherein the pair of signal conductors respectively transmit positive and negative signals.

9. The cable assembly of claim 1, wherein the cover is made of metallic material.

10. The cable assembly as claimed in claim 1, further comprising a pair of fastening members, the cover defines a pair of receiving passages at opposite sides thereof, and wherein the fastening members are respectively movably received in the receiving passages for engaging with a complementary connector.

11. The cable assembly of claim 10, further comprising a pair of springs respectively assembled to the fastening members for disengaging the cable assembly from the complementary connector.

12. The cable assembly of claim 1, wherein the printed circuit board forms a plurality of first conductive traces on a front portion thereof, and wherein the contacts comprise tail portions are soldered to the first conductive traces.

13. The cable assembly of claim 12, wherein the printed circuit board forms a plurality of second and third conductive traces on a middle portion and a rear portion thereof, and wherein the conductors of the cable are respectively soldered to the second and third conductive traces.

14. The cable assembly of claim 13, wherein the second and third conductive traces are arranged with equal trace number and interval.

15. The cable assembly of claim 1, wherein the insulative housing comprises a base portion and a pair of supporting portions extending rearward from the base portion, and wherein the printed circuit board is assembled to the supporting portions of the insulative housing.

16. A cable assembly, comprising:

a connector module comprising:

an insulative housing defining a front-to-back direction, a vertical direction and a transverse direction perpendicular to one another;

a plurality of contacts assembled to the insulative housing;

at least two cables extending along the front-to-back direction, each of said cables essentially being a differential pair and having a lying capsular cross-section, said cables arranged to be stacked upon each other in a vertical direction while with front ends offset from each other in said front-to-back direction to electrically connect to the corresponding contacts, respectively;

a cover enclosing the connector and defining a trough hole at a rear end; and a train relief section interferentially located in said through and encircling said two cables.

17. The cable assembly as claimed in claim 16 wherein at least one of said cables is deflected toward the other to have the front ends of said two stacked cables are essentially located at a same horizontal plane; wherein said horizontal plane is defined by a printed circuit board on which the front ends are surface-mounted.

18. The cable assembly as claimed in claim 16 wherein another two cables are side by side located beside said two cables in the transverse direction, and are encircled in said strain relief section.

19. The cable assembly as claimed in claim 17, wherein both said at least two cables define front deflected sections in compliance with a thickness of the printed circuit board.

20. The cable assembly as claimed in claim 17, wherein another two cables are stacked to said at least two cables, front ends of said another two cables are surface mounted to another horizontal plane of the printed circuit board opposite to said horizontal plane and cooperate with said at least two cables to sandwich the printed circuit board therebetween.

21. A cable assembly, comprising:

a connector module comprising:

an insulative housing defining a front-to-back direction, a vertical direction and a transverse direction perpendicular to one another;

a plurality of contacts assembled to the insulative housing;

a plurality of cables extending along the front-to-back direction with front ends located adjacent to and in alignment with the corresponding contacts, respectively;

a cover enclosing the connector module and defining a through hole at a rear end; and an integrally formed strain relief devices including a large main portion at least partially covering said front ends of the cables, and a small stain relief section interferentially circumferentially received in said through hole and fully encircling said cables.

22. The cable assembly as claimed in claim 21, wherein the front ends of the cables are mounted upon a printed circuit board, and the large main portion is seated upon said printed circuit board to downwardly cover the front ends.

* * * * *